United States Patent [19]

Kiribuchi

[11] Patent Number: 4,815,727

[45] Date of Patent: Mar. 28, 1989

[54] INDOOR JUNGLE GYM ASSEMBLY

[75] Inventor: Shin-ichiro Kiribuchi, Tokyo, Japan

[73] Assignee: People Co., Ltd., Tokyo, Japan

[21] Appl. No.: 63,915

[22] Filed: Jun. 19, 1987

[30] Foreign Application Priority Data

Apr. 27, 1987 [JP] Japan ..... 62-062723

[51] Int. Cl.[4] ..... F16B 7/00

[52] U.S. Cl. ..... 272/1 R; 272/109; 52/640; 403/172; 403/176; 182/178

[58] Field of Search ..... 272/1 R, 113, 112, 109, 272/56.5 R; 52/638, 648; 403/171, 172, 176; 182/178

[56] References Cited

U.S. PATENT DOCUMENTS

| | | | |
|---|---|---|---|
| 1,269,326 | 1/1918 | Slatter | 52/638 |
| 1,765,361 | 6/1930 | Berman | 272/1 R X |
| 2,768,828 | 10/1956 | Pack | 272/56.5 R |
| 2,874,708 | 2/1959 | Daws, Jr. | 403/172 X |
| 2,936,530 | 5/1960 | Bowen | 403/171 X |
| 3,462,021 | 8/1969 | Hawke et al. | 182/178 X |
| 3,851,601 | 12/1974 | Davis | 403/171 X |
| 3,858,989 | 1/1975 | Field | 403/171 |
| 3,972,882 | 2/1974 | Varichon | 403/171 |
| 4,516,376 | 5/1985 | King | 52/648 |
| 4,630,550 | 12/1986 | Weitzman | 403/171 X |

FOREIGN PATENT DOCUMENTS

| | | | |
|---|---|---|---|
| 2147680 | 5/1985 | United Kingdom | 403/172 |

*Primary Examiner*—David A. Scherbel
*Assistant Examiner*—Richard E. Chilcot, Jr.
*Attorney, Agent, or Firm*—Wegner & Bretschneider

[57] ABSTRACT

An indoor jungle gym assembly comprises a plurality of paper pipes having a multi-wound cylindrical body formed on its surface with a synthetic resin film and a plurality of joints formed of a synthetic resin comprising a hollow columnar member provided around its inner center with ribs capable of being fitted over the paper pipe and extension extending at right angles with respect to the axis of the paper pipe and being able to be fitted in the paper pipe. The plurality of joints are of the L-shaped type having two extensions subtending therebetween an angle of 90 degrees, the T-shaped type having three extensions each one of which subtends an angle of 90 degrees with respect to the other, and the cross-shaped type having four extensions each one of which subtends an angle of 90 degrees with respect to the other.

5 Claims, 2 Drawing Sheets

INDOOR JUNGLE GYM ASSEMBLY

BACKGROUND OF THE INVENTION

1. Field of the Invention

The present invention relates to an indoor jungle gym assembly, particularly one with which infants or little children play.

2. Statement of the Prior Art

Hitherto, jungle gyms have been located in playlands or parks, and have provided playthings with which little children could amuse themselves. However, since currently available jungle gyms are erected outdoors, parents have to take their children out where they are located. In addition, since such jungle gyms are usually formed of a hard material such as iron that may be dangerous to infants whose motor function is not sufficiently developed, parents always have to watch them playing around therein.

Further, where the pipes forming part of the jungle gym are formed of a synthetic resin, there is a fear of infants being injured by fragments of the synthetic resin, whey they are broken.

Still further, where such pipes are formed of a metal such as iron, it is required to increase the thickness thereof to obtain the desired strength. Another problem arises in connection with the coldness characteristic of the metal, which infants dislike.

As well-known in the art, vigorously hand and foot movement is effective for the infant's development of both the bodies and brain proper. Jungle gyms are one of the playthings chilren so prefer, and best-suited for their exercise. Accordingly, there has still been a dmand for a jungle gym assembly which can be used indoors in safety.

SUMMARY OF THE INVENTION

An object of the present invention is to provide an indoor jungle gym assembly which is free from the disadvantages found in the prior art, and with which infants can safely play indoors, while they move vigorously their hands and feet, thus resulting in the promotion of the development of their bodies and brain proper.

More specifically, the aforesaid object of the present invention is achieved by the provision of an indoor jungle gym assembly comprising a plurality of paper pipes and a plurality of joints, wherein: each of said paper pipes comprises a multi-wound cylindrical body formed on its surface with a synthetic resin film; each of said joints is formed of a synthetic resin and comprises a hollow columnar member capable of being fitted over said each paper pipe and having extensions extending at right angles with the axis of said paper pipe and able to be fitted into said paper pipe;

said columnar member is provided around its inner center with a rib; and said joints are of the L-shaped type having two extensions subtending therebetween an angle of 90 degrees, the T-shaped type having three extensions each one of which subtends an angle of 90 degrees with respect to the other, and the cross-shaped type having four extensions each one of which subtends an angle of 90 degrees with respect to the other.

BRIEF DESCRIPTION OF THE DRAWINGS

For a better understanding of the nature and objects of the invention, reference should be made to the following detailed description taken in conjunction with the accompanying drawings, in which.

Figure 1:
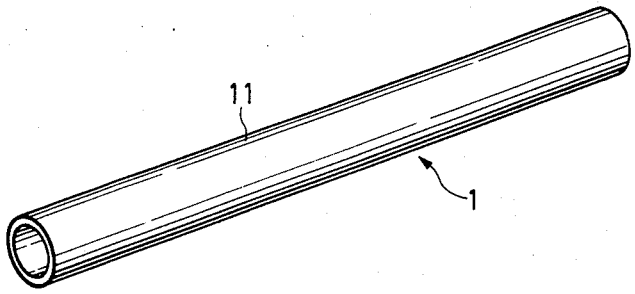
FIG. 1 is a perspective view of one paper pipe used in the present invention.

In the drawings, reference numeral 1 indicates a paper pipe, aa a synthetic resin film, 2 a joint, 21 a columnar member, 22 extensions, and 23 stands for a rib.

DETAILED DESCRIPTION OF THE PREFERRED EMBODIMENTS

The paper pipe 1 comprises a cylindrical body of a multi-wound paper sheet, and is formed on its surface with the synthetic resin film 11. In one embodiment of the present invention, the paper pipe 1 is 280 mm in length, 31 mm in outer diameter and 25 mm in inner diameter. Multi-winding of paper into a cylindrical body may e achieved by suitable manners now available in the art. By way of example, a cylindrical model is first provided, which is designed such that the paper pipe to be obtained is 25 mm in inner diameter, with the contraction of paper in mind. Paper of about 30 mm in width is then spirally wound around this model to a desired thickness, followed by winding of colored paper. Finally, a synthetic resin film to provide the synthetic resin film 11 is wound around the colored paper. For the colored paper and the synthetic resin film, a combination of colored paper and a synthetic resin film laminated thereon may be substituted. Alternatively, the cylindrically shaped paper pipe 1 may be obtained by previously applying on the surface of said paper a bonding agent which will produce its adhesive effect of heating, winding said paper around the model to a desired thickness, and heating the thus wound paper for integral bonding, followed by removal of the model. Further, a paper sheet with a colored synthetic resin being laminated thereof may be applied over a surface portion of the paper pipe to provide the synthetic resin film 11. Still further, the surface portion of the paper pipe to provide the synthetic resin film 11 may also be coated with a colored synthetic resin, etc. Still further, the paper to be used may be specially reinforced paper incorporated therein with a synthetic resin, etc.

It is unlikely that the thus formed paper pipe 1 may break, while an infant plays with the jungle gym constructed therefrom. In case the pipe 1 breaks, there is not any possibility for the infant to be injured, since it is formed of paper. The application of the colored synthetic resin film on the surface of the paper pipe 1 makes the general appearance of the jungle gym aesthetic, and so gives infants visual pleasure. Even when the paper pipe 1 is slobbered, the surface synthetic resin film 11 prevents slaver from wetting the paper and, hence, the prevented strength of the paper pipe 1 from dropping.

Figure 3:
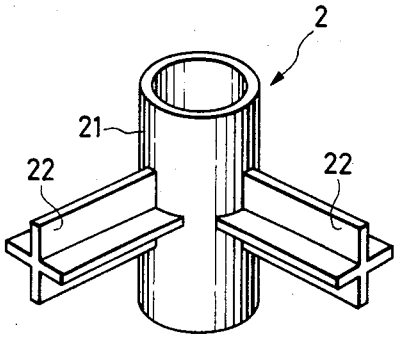
FIG. 3 is a perspective view of one L-shaped joint used in the present invention.
Figure 2:
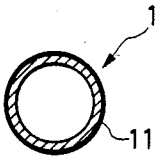
FIG. 2 is a sectional view of the paper pipe of FIG. 1.

Referring to FIG. 3, the joint 2 is formed of a synthetic resin so as to easily form it into a complicated shape which affords a sufficient strength to it, and allows fabrication of it at lower costs. Examples of the synthetic resin to be used may include polypropylene.

Each joint 2 comprising a hollow, columnar member 21 to be fitted over the paper pipe 1 and side extensions 22 which extend at right angles with respect to the axis of the pipe 1 and can be fitted into the pipe 1.

Figure 4:
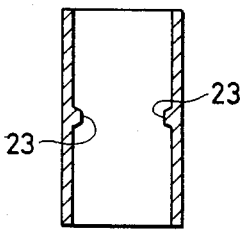
FIG. 4 is an end view, centrally and longitudinally sectioned, of FIG. 3.
Figure 5:
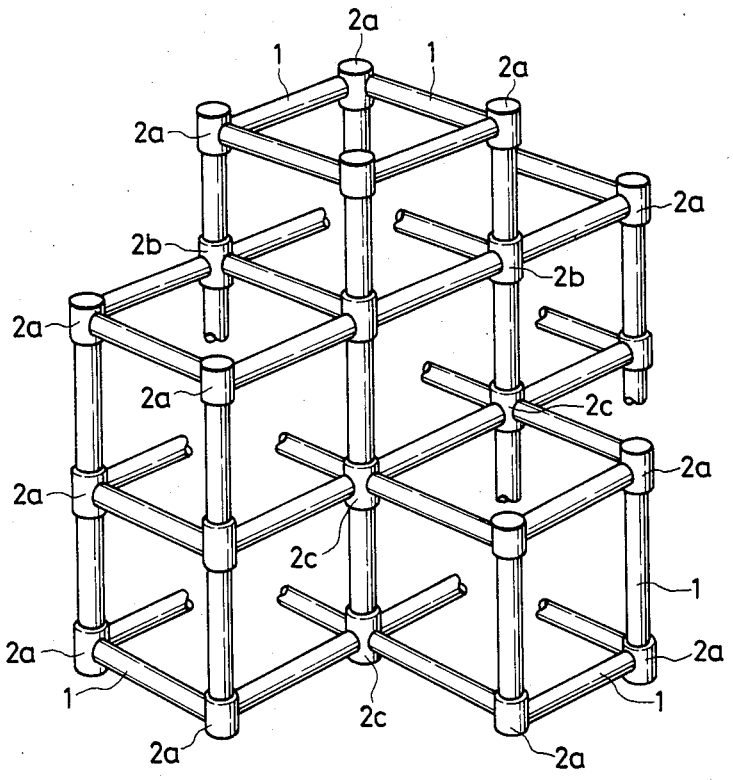
FIG. 5 is a perspective view of one embodiment of the completed jungle gym assembly according to the present invention.

In this embodiment, the columnar member 21 is about 31 mm in inner diameter, and can easily be fitted over the pipe 1 of 31 mm in outer diameter. As illustrated in FIG. 4, the columnar member 21 is provided around its inner center with a rib 23, which engages the paper pipe 1 and thereby prevents it from going further in the columnar member 21. Therefore, a plurality of the paper pipes 1 are longitudinally joined by a plurality of the joints 2 to assemble a jungle gym, as illustrated in FIG. 5.

The joints 2 to be used are of the three types; the L-shaped joint **2*a* having two extensions 22 subtending therebetween an angle of 90 degrees, the T-shaped joint 2*b* having three extensions 22, each one of which subtends an angle of 90 degrees with respect to the other, and the cross-shaped joint 2*c* having four extensions 22**, each one of which subtends an angle of 90 degrees with respect to the other.

Each extension 22 extends at right angles with respect to the axis of the columnar member 21, and can be fitted into the cylindrical body 11 of the paper pipe 1. As illustrated in FIG. 3, the extension 22 is of cruciform in section, and is so round-cornered that it can easily be fitted into the cylindrical body 11 of the paper pipe 1. The paper pipe 1 is slightly deformed by fitting the extension 11 thereinto, whereby the extension 22 keeps the paper pipe 1 in place with a stronger bonding force occurring therebetween. Production of such a strong bonding force is derived from the fact that the pipe 1 is formed of paper, and is not achievable with pipes made of synthetic resins or metals such as iron.

The jungle gym assembly of the present invention is obtained by suitable combinations of the paper pipes 1 with the L-shaped, T-shaped and cross-shaped joints 22. FIG. 5 is a perspective view of one embodiment of the completed jungle gym assembly according to the present invention, which is of the construction suitable for infants to play with. It is understood, however, that modifications or changes may be made to that construction, if desired.

Separately provided end caps may be fitted over the mouths of the columnar members 21 of the joints to be placed on the floor or exposed to open view for the purpose of preventing the floor from being damaged or making the general appearance of the assembled jungle gym more aesthetic.

I claim:

1. An outdoor jungle gym assembly comprising:

a plurality of vertical support pipes and a plurality of horizontal support pipes, each of said vertical and horizontal support pipes comprising a multi-wound hollow cylindrical body made of paper and a synthetic resin film on the surface of the cylindrical body; and a plurality of joint members connecting said horizontal support pipes and said vertical support pipes, each of said joint members being formed of a synthetic resin and comprising:

a hollow columnar member capable of being fit over the ends of said vertical support pipes;

at least two spigots extending from said columnar member at right angles with respect to the longitudinal axis of the columnar member, said spigots subtending an angle of 90° with respect to each other and being able to be inserted into ends of said horizontal pipes; and a rib extending inwardly from the inner wall of said columnar member.

2. The jungle gym assembly as claimed in claim 1, wherein at least one of said joint member comprises two spigots extending from the columnar member which form an L shape.

3. The jungle gym assembly as claimed in claim 1, wherein at least one of said joint members comprises three spigots extending from the columnar member which form a T shape.

4. The jungle gym assembly as claimed in claim 1, wherein at least one of said joint members comprises four spigots extending from the columnar member which form a cross shape.

5. The jungle gym assembly as claimed in claim 1, wherein each of said spigots are cruciform in cross-section.

* * * * *